US007861482B2

(12) United States Patent
Pervan et al.

(10) Patent No.: US 7,861,482 B2
(45) Date of Patent: Jan. 4, 2011

(54) LOCKING SYSTEM COMPRISING A COMBINATION LOCK FOR PANELS

(75) Inventors: Darko Pervan, Viken (SE); Christian Boo, Kagerod (SE)

(73) Assignee: Valinge Innovation AB, Viken (SE)

( * ) Notice: Subject to any disclaimer, the term of this patent is extended or adjusted under 35 U.S.C. 154(b) by 202 days.

(21) Appl. No.: 11/770,771

(22) Filed: Jun. 29, 2007

(65) Prior Publication Data

US 2008/0010931 A1 Jan. 17, 2008

Related U.S. Application Data

(60) Provisional application No. 60/830,677, filed on Jul. 14, 2006.

(51) Int. Cl.
*E04B 5/00* (2006.01)

(52) U.S. Cl. ..... 52/586.1; 52/177; 52/589.1; 52/747.1

(58) Field of Classification Search ..... 52/588.1, 52/592.1, 582.2, 582.1, 586.1, 586.2, 585.1, 52/591.1

See application file for complete search history.

(56) References Cited

U.S. PATENT DOCUMENTS

| | | | |
|---|---|---|---|
| 124,228 | A | 3/1872 | Stuart |
| 1,723,306 | A | 8/1929 | Sipe |
| 1,743,492 | A | 1/1930 | Sipe |
| 1,787,027 | A | 12/1930 | Wasleff |
| 1,809,393 | A | 6/1931 | Rockwell |
| 1,902,716 | A | 3/1933 | Newton |
| 1,925,070 | A | 8/1933 | Livezey |
| 1,995,264 | A | 3/1935 | Mason |
| 2,015,813 | A | 10/1935 | Nielsen |
| 2,026,511 | A | 12/1935 | Storm |
| 2,088,238 | A | 7/1937 | Greenway |
| 2,089,075 | A | 8/1937 | Siebs |
| 2,204,675 | A | 9/1937 | Grunert |
| 2,303,745 | A | 12/1942 | Karreman |
| 2,430,200 | A | 11/1947 | Wilson |
| 2,596,280 | A | 5/1952 | Nystrom |

(Continued)

FOREIGN PATENT DOCUMENTS

CA 2 456 513 A1 2/2003

(Continued)

OTHER PUBLICATIONS

International Search Report issued in PCT/SE2007/000635 (Published as WO 2008/008016 A1), Nov. 6, 2007, Swedish Patent Office, Stockholm, SE.

(Continued)

*Primary Examiner*—Richard E Chilcot, Jr.
*Assistant Examiner*—Chi Nguyen
(74) *Attorney, Agent, or Firm*—Buchanan Ingersoll & Rooney PC

(57) ABSTRACT

A locking system for a floor panel includes a first connecting device, a second connecting device, and a third connecting device. The first connecting device includes a combination lock including an upwardly directed locking element configured to cooperate with a locking groove. The combination lock further including a flexible tongue in a displacement groove. The displacement groove and the flexible tongue of the combination lock are configured to cooperate with a tongue of a third connecting device.

26 Claims, 12 Drawing Sheets

U.S. PATENT DOCUMENTS 2,732,706 A 1/1956 Friedman
2,740,167 A 4/1956 Rowley
2,865,058 A 12/1958 Andersson
3,023,681 A 3/1962 Worson
3,378,958 A 4/1968 Parks et al.
3,436,888 A 4/1969 Ottosson
3,512,324 A 5/1970 Reed
3,517,927 A 6/1970 Kennel
3,526,071 A 9/1970 Watanabe
3,535,844 A 10/1970 Glaros
3,554,850 A 1/1971 Kuhle
3,572,224 A 3/1971 Perry
3,579,941 A 5/1971 Tibbals
3,731,445 A 5/1973 Hoffmann
3,742,669 A 7/1973 Mansfeld
3,849,235 A 11/1974 Gwynne
3,919,820 A 11/1975 Green
4,082,129 A 4/1978 Morelock
4,100,710 A 7/1978 Kowallik
4,107,892 A 8/1978 Bellem
4,113,399 A 9/1978 Hansen, Sr.
4,169,688 A 10/1979 Toshio
4,196,554 A 4/1980 Anderson
4,299,070 A 11/1981 Oltmanns et al.
4,304,083 A 12/1981 Anderson
4,426,820 A 1/1984 Terbrack et al.
4,512,131 A * 4/1985 Laramore ..... 52/586.1
4,599,841 A 7/1986 Haid
4,819,932 A 4/1989 Trotter, Jr.
5,148,850 A 9/1992 Urbanick
5,182,892 A 2/1993 Chase
5,247,773 A 9/1993 Weir
5,295,341 A 3/1994 Kajiwara
5,344,700 A 9/1994 McGath et al.
5,349,796 A 9/1994 Meyerson
5,465,546 A 11/1995 Buse
5,577,357 A 11/1996 Civelli
5,598,682 A 2/1997 Haughian
5,618,602 A 4/1997 Nelson
5,634,309 A 6/1997 Polen
5,755,068 A 5/1998 Ormiston
5,860,267 A 1/1999 Pervan
5,899,038 A 5/1999 Stroppiana
5,950,389 A * 9/1999 Porter ..... 52/586.1
6,006,486 A 12/1999 Moriau
6,052,960 A 4/2000 Yonemura
6,173,548 B1 1/2001 Hamar et al.
6,182,410 B1 * 2/2001 Pervan ..... 52/403.1
6,203,653 B1 3/2001 Seidner
6,216,409 B1 4/2001 Roy et al.
6,254,301 B1 7/2001 Hatch
6,314,701 B1 11/2001 Meyerson
6,332,733 B1 12/2001 Hamberger et al.
6,363,677 B1 4/2002 Chen
6,385,936 B1 5/2002 Schneider
6,418,683 B1 * 7/2002 Martensson et al. ..... 52/282.1
6,446,413 B1 9/2002 Gruber
6,490,836 B1 12/2002 Moriau
6,505,452 B1 1/2003 Hannig
6,536,178 B1 3/2003 Palsson et al.
6,553,724 B1 4/2003 Bigler
6,591,568 B1 * 7/2003 Pålsson ..... 52/592.2
6,601,359 B2 8/2003 Olofsson
6,647,689 B2 11/2003 Heitzinger
6,647,690 B1 11/2003 Martensson
6,729,091 B1 5/2004 Martensson
6,763,643 B1 * 7/2004 Mårtensson ..... 52/586.1
6,769,219 B2 8/2004 Schwitte et al.
6,802,166 B1 10/2004 Dirnberger
6,854,235 B2 2/2005 Martensson
7,040,068 B2 * 5/2006 Moriau et al. ..... 52/591.3
7,051,486 B2 5/2006 Pervan
7,127,860 B2 10/2006 Pervan et al.
7,275,350 B2 10/2007 Pervan et al.
7,377,081 B2 5/2008 Ruhdorfer
7,454,875 B2 11/2008 Pervan et al.
7,568,322 B2 8/2009 Pervan
7,584,583 B2 9/2009 Bergelin et al.
7,614,197 B2 11/2009 Nelson
7,617,651 B2 11/2009 Grafenauer
2002/0007608 A1 1/2002 Pervan
2002/0007609 A1 1/2002 Pervan
2002/0056245 A1 5/2002 Thiers
2002/0083673 A1 7/2002 Kettler et al.
2002/0092263 A1 7/2002 Schulte
2002/0178674 A1 12/2002 Pervan
2003/0009971 A1 1/2003 Palmberg
2003/0024199 A1 2/2003 Pervan et al.
2003/0101681 A1 6/2003 Tychsen
2003/0180091 A1 9/2003 Stridsman
2003/0188504 A1 10/2003 Ralf
2003/0196405 A1 10/2003 Pervan
2004/0031227 A1 2/2004 Knauseder
2004/0060255 A1 4/2004 Knauseder
2004/0068954 A1 4/2004 Martensson
2004/0168392 A1 9/2004 Konzelmann et al.
2004/0182036 A1 9/2004 Sjoberg et al.
2004/0200175 A1 10/2004 Weber
2004/0211143 A1 10/2004 Hanning
2005/0160694 A1 7/2005 Pervan
2005/0210810 A1 9/2005 Pervan
2005/0235593 A1 10/2005 Hecht
2005/0252130 A1 11/2005 Martensson
2006/0032168 A1 2/2006 Thiers et al.
2006/0070333 A1 4/2006 Pervan
2006/0101769 A1 5/2006 Pervan et al.
2006/0236642 A1 10/2006 Pervan
2006/0260254 A1 11/2006 Pervan
2007/0006543 A1 1/2007 Engstrom
2007/0028547 A1 2/2007 Grafenauer
2007/0108679 A1 5/2007 Grothaus
2007/0151189 A1 7/2007 Yang
2007/0193178 A1 8/2007 Groeke et al.
2007/0209736 A1 9/2007 Deringor et al.
2008/0000186 A1 1/2008 Pervan
2008/0010937 A1 1/2008 Pervan
2008/0028707 A1 2/2008 Pervan
2008/0034708 A1 2/2008 Pervan
2008/0041008 A1 2/2008 Pervan
2008/0066415 A1 3/2008 Pervan
2008/0104921 A1 5/2008 Pervan
2008/0110125 A1 5/2008 Pervan
2008/0134607 A1 6/2008 Pervan
2008/0134613 A1 6/2008 Pervan
2008/0134614 A1 6/2008 Pervan
2008/0155930 A1 7/2008 Pervan
2008/0172971 A1 7/2008 Pervan
2008/0216434 A1 9/2008 Pervan
2008/0216920 A1 9/2008 Pervan
2008/0236088 A1 10/2008 Hannig
2008/0295432 A1 12/2008 Pervan
2009/0193753 A1 8/2009 Schitter

FOREIGN PATENT DOCUMENTS

DE 2 159 042 A1 6/1973
DE 33 43 601 A1 6/1985
DE 42 15 273 A1 11/1993
DE 42 42 530 A1 6/1994
DE 196 01 322 A1 5/1997
DE 199 40 837 A1 11/2000
DE 199 58 225 A1 6/2001
DE 10 2004 001 363 A1 8/2005
DE 10 2005 024 366 A1 11/2006

| | | | |
|---|---|---|---|
| EP | 0 013 852 | A1 | 8/1980 |
| EP | 0 652 340 | A1 | 5/1995 |
| EP | 0 974 713 | A1 | 1/2000 |
| EP | 1 120 515 | A1 | 8/2001 |
| EP | 1 146 182 | A2 | 10/2001 |
| EP | 1 308 577 | A2 | 5/2003 |
| EP | 1 350 904 | A2 | 10/2003 |
| EP | 1 350 904 | A3 | 10/2003 |
| EP | 1 640 530 | A2 | 3/2006 |
| EP | 1 650 375 | A1 | 4/2006 |
| FR | 1.138.595 | | 6/1957 |
| FR | 2 256 807 | | 8/1975 |
| FR | 2 810 060 | A1 | 12/2001 |
| GB | 2 051 916 | A | 1/1981 |
| JP | 3-110258 | A | 5/1991 |
| JP | 6-146553 | A | 5/1994 |
| JP | 07-310426 | A | 11/1995 |
| JP | 10-219975 | A | 8/1998 |
| WO | WO 94/26999 | A1 | 11/1994 |
| WO | WO 96/27719 | A1 | 9/1996 |
| WO | WO 96/27721 | A1 | 9/1996 |
| WO | WO 97/47834 | A1 | 12/1997 |
| WO | WO 98/38401 | A1 | 9/1998 |
| WO | WO 99/66151 | A1 | 12/1999 |
| WO | WO 99/66152 | A1 | 12/1999 |
| WO | WO 00/20705 | A1 | 4/2000 |
| WO | WO 00/20706 | A1 | 4/2000 |
| WO | WO 00/47841 | A1 | 8/2000 |
| WO | WO 01/02672 | A1 | 1/2001 |
| WO | WO 01/07729 | A1 | 2/2001 |
| WO | WO 01/51732 | A1 | 7/2001 |
| WO | WO 01/66877 | A1 | 9/2001 |
| WO | WO 01/77461 | A1 | 10/2001 |
| WO | WO 01/98604 | A1 | 12/2001 |
| WO | WO 02/055809 | A1 | 7/2002 |
| WO | WO 02/055810 | A1 | 7/2002 |
| WO | WO 03/025307 | A1 | 3/2003 |
| WO | WO 03/083234 | A1 | 10/2003 |
| WO | WO 03/087497 | A1 | 10/2003 |
| WO | WO 03/089736 | A1 | 10/2003 |
| WO | WO 2004/020764 | A1 | 3/2004 |
| WO | WO 2004/079130 | A1 | 9/2004 |
| WO | WO 2004/083557 | A1 | 9/2004 |
| WO | WO 2005/054599 | A1 | 6/2005 |
| WO | WO 2006/043893 | A1 | 4/2006 |
| WO | WO 2006/050928 | A1 | 5/2006 |
| WO | WO 2007/015669 | A1 | 2/2007 |

OTHER PUBLICATIONS

Boo, U. S. Appl. No. 12/362,977, entitled "Mechanical Locking of Floor Panels", filed Feb. 18, 2009.

U.S. Appl. No. 12/518,584, Pervan, et al.

Pervan, Darko, et al., U.S. Appl. No. 12/518,584, entitled, "Mechanical Locking of Floor Panels," Jun. 10, 2009.

Pervan, Darko, et al., U.S. Appl. No. 12/868,137, entitled "Mechanical Locking System For Floor Panels, " filed in the U.S. Patent and Trademark Office on Aug. 25, 2010.

* cited by examiner

1

2

3

4

Prior Art

Prior Art

LOCKING SYSTEM COMPRISING A COMBINATION LOCK FOR PANELS

CROSS-REFERENCE TO RELATED APPLICATION

The present application claims the benefit of U.S. Provisional Application Ser. No. 60/830,677, which was filed on Jul. 14, 2006, and the entire contents thereof are incorporated herein by reference.

FIELD OF THE INVENTION

The invention generally relates to the field of floor panels with mechanical locking systems with a flexible and displaceable tongue.

BACKGROUND

In particular, yet not in a restrictive manner, the disclosure concerns a locking system for a floor panel and a set of floor panels mechanically joined to preferably a floating floor. However, the disclosure is as well applicable to building panels in general. More particularly, the disclosure relates to the type of mechanically locking systems comprising a flexible or partly flexible tongue and/or a displaceable tongue, in order to facilitate the installation of building panels.

A floor panel of this type is presented in WO2006/043893, which discloses a floor panel with a locking system comprising a locking element cooperating with a locking groove, for horizontal locking, and a flexible tongue cooperating with a tongue groove, for locking in a vertical direction. The flexible tongue bends in the horizontal plane during connection of the floor panels and makes it possible to install the panels by vertical folding or solely by vertical movement. By "vertical folding" is meant a connection of three panels where a first and second panel are in a connected state and where a single angling action connects two perpendicular edges of a new panel, at the same time, to the first and second panel. Such a connection takes place for example when a long side of the first panel in a first row is already connected to a long side of a second panel in a second row. The third panel is then connected by angling to the long side of the first panel in the first row. This specific type of angling action, which also connects the short side of the new panel and second panel, is referred to as "vertical folding". It is also possible to connect two panels by lowering a whole panel solely by vertical movement against another panel.

DEFINITION OF SOME TERMS

In the following text, the visible surface of the installed floor panel is called "front face", while the opposite side of the floor panel, facing the sub floor, is called "rear face". The edge between the front and rear face is called "joint edge". By "horizontal plane" is meant a plane, which extends parallel to the outer part of the surface layer. Immediately juxtaposed upper parts of two adjacent joint edges of two joined floor panels together define a "vertical plane" perpendicular to the horizontal plane.

By "joint" or "locking system" are meant co-acting connecting means, which connect the floor panels vertically and/or horizontally. By "mechanical locking system" is meant that joining can take place without glue. Mechanical locking systems can in many cases also be combined with gluing. By "integrated with" means formed in one piece with the panel or factory connected to the panel.

By a "flexible tongue" is meant a separate tongue which has a length direction along the joint edges and which is forming a part of the vertical locking system and could be displaced horizontally during locking. The tongue could for example be bendable or have a flexible and resilient part in such a way that it can bend along its length and spring back to its initial position.

By "angling" is meant a connection that occurs by a turning motion, during which an angular change occurs between two parts that are being connected, or disconnected. When angling relates to connection of two floor panels, the angular motion takes place with the upper parts of joint edges at least partly being in contact with each other, during at least part of the motion.

OBJECTS AND SUMMARY

The present disclosure discloses a locking system and a set of floor panels or a floating flooring, which provides for new embodiments according to different aspects offering respective advantages. Useful areas for the disclosure are floor panels of any shape and material e.g. laminate, wood, HDF, veneer or stone.

According to a first object, the disclosure provides for locking system for a floor panel comprising a first connecting device. The first connecting device comprises a combination lock configured to lock horizontally and vertically to a second and third connecting devices of a second and third connecting device, respectively. The combination lock comprises a locking element for cooperating with a locking grove of the second and third connecting device, for the horizontal locking. Further more, the combination lock comprises a flexible tongue and displacement groove, configured to cooperate with a flexible tongue groove of the second floor panel and a tongue of a third floor panel.

As the locking system for a floor panel according to the first object is provided with a flexible and displaceable tongue, displaceable in a displacement groove and configured to cooperate with a flexible tongue groove as well as with a tongue, this offers several advantages. A first advantage is that it is possible to connect one side of a floor panel with a first connecting device to two different connecting devices. A second advantage is that a strong joint is provided and a third that the height position between the floor panels, in the short edge to long edge joint is improved.

A locking system for a floor panel of this type is known from WO2006/043893, as mentioned above, and discloses a bow shaped flexible tongue bendable in the length direction. The drawback of this locking system is that if it is used on a joint between a long and short side it weakens the joint. The first panel has a long edge of an angling type (see FIG. 10*a*), comprising a locking element and a tongue groove. To facilitate the connection to a short side of a second panel, the short side is provided with a flexible tongue and a displacement groove. This results in a very thin section between the bottom of the displacement groove and the locking groove. The thin section makes the joint weak and it's likely that this thin section will crack when the joint is put under load.

Preferably, the length of the displacement groove is at least equal to the sum of the width of the flexible tongue and the tongue.

Preferably, the width of the entrance E of the displacement groove is at least equal to the thickness TT of the tongue.

Preferably, the flexible tongue is displaceable via the tongue.

Preferably, the panels joined are of A and B type, with mirror inverted connecting devices.

Preferably, the flexible tongue has a straight outer edge and an inner edge with bendable protrusions.

According to a second object, the disclosure provides for a set of floor panels comprising the combination lock above at two of the edges of a first panel, configured to cooperate with the second connecting device of a second panel and with a third connecting device of a third panel. The set of floor panels has the same advantage as mentioned above and it is provides for easy installation of advanced patterns.

All references to "a/an/the [element, device, component, means, step, etc]" are to be interpreted openly as referring to at least one instance of said element, device, component, means, step, etc., unless explicitly stated otherwise.

DESCRIPTION OF PREFERRED EMBODIMENTS OF THE INVENTION

As represented in FIGS. 1-3 and 7-12, the invention relates to a locking system and a set of floor panels with a displaceable tongue.

Figure 1A:
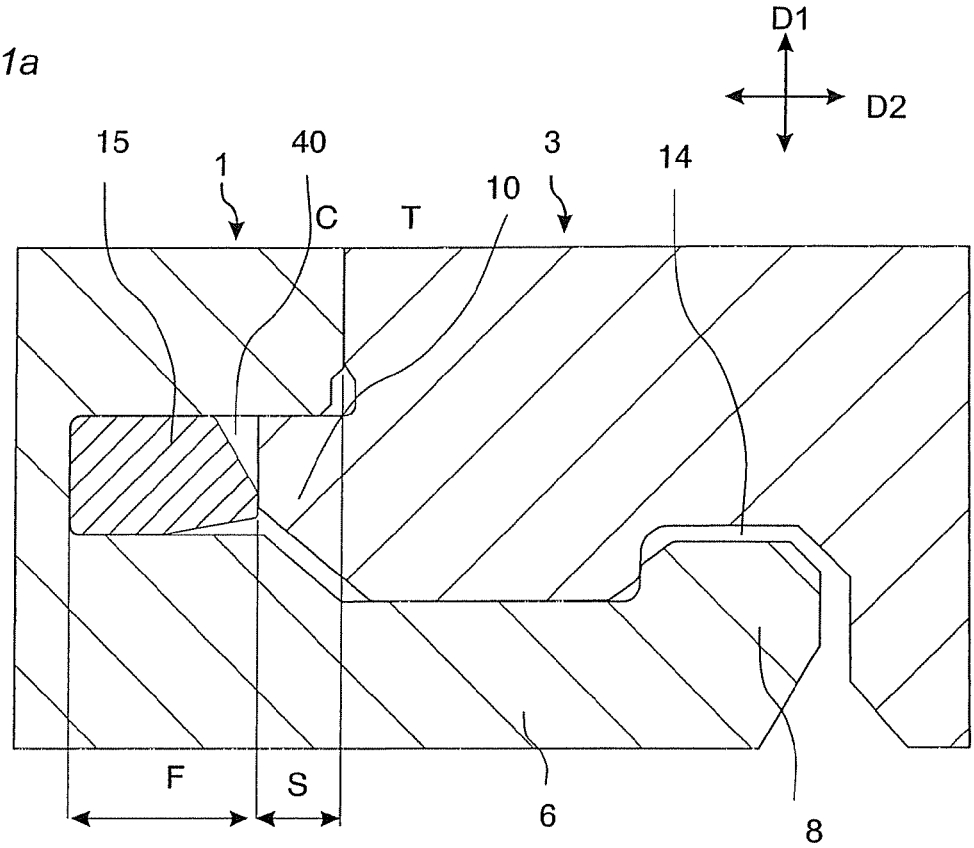
FIGS. 1*a-b* illustrate a locking system according to an embodiment of the invention.
Figure 1B:
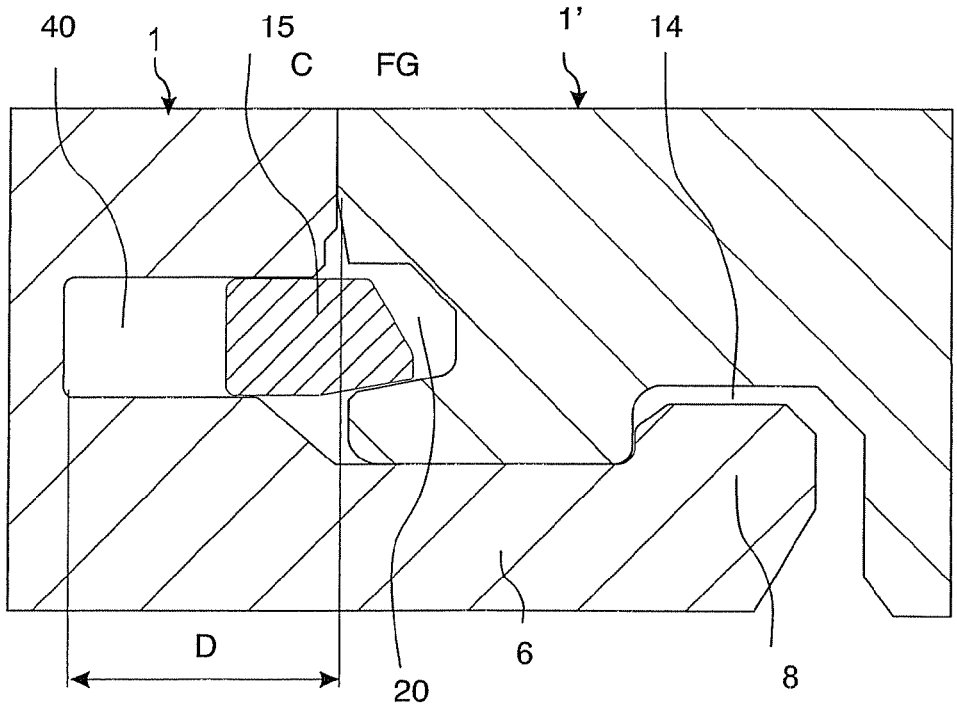

FIGS. 1*a-b* show an embodiment of a locking system according to the invention. FIG. 1*b*, shows the locking system in a state wherein a first connecting device, a combination lock C, of a first panel 1, is connected to a second connecting device FG of a second panel 1'. The combination lock comprises a locking strip 6 and an upwardly projected locking element 8 cooperating with a locking groove 14 of the second connecting device for horizontal locking. Further more, the combination lock comprises a flexible and displaceable tongue 15, displaceable in a displacement groove 40, cooperating with a flexible tongue groove 20, of the second connecting device for locking in the vertical direction. Henceforward, the second connecting device will be referred to as a FG-lock. FIG. 1*a*, shows the locking system in a state wherein the combination lock is connected to a third connecting device T of a third panel 3. The third connecting device comprising a locking groove 14 cooperating with the locking element of the combination lock for horizontal locking. Further, the third connecting device comprises a tongue, pushing the flexible tongue of the combination lock into the displacement groove, and cooperating with the displacement groove for locking in the vertical direction. Henceforward, the third connecting device will be referred to as a T-lock FIGS. 1*a-b* show an embodiment with a depth D of the displacement groove 40 equal to the width of the flexible tongue F and the tongue S. A deeper displacement groove is possible, and also a shallower is possible if the properties of the tongue allow compression and/or foiling.

Figure 2:
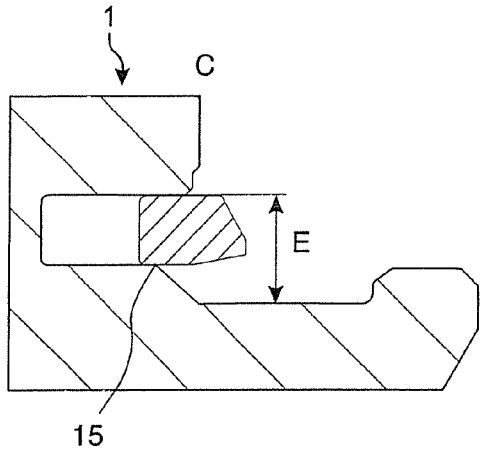
FIG. 2 shows an installation of two panels according to an embodiment of the invention, a tongue side of a panel is connecting a tongue side of an adjacent panel.
Figure 2:
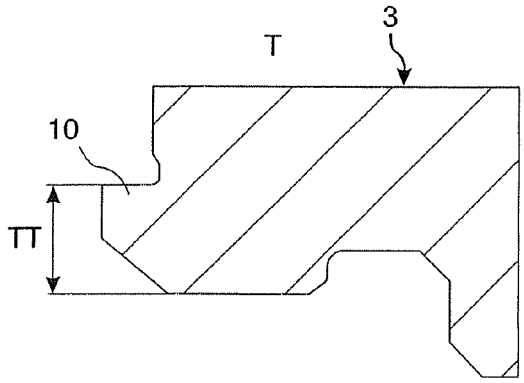
Figure 2:
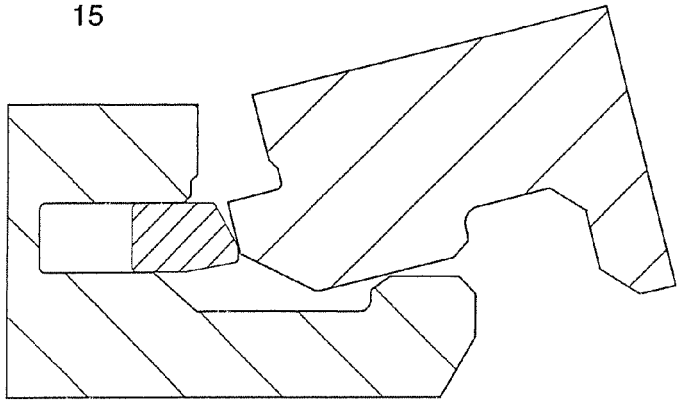
Figure 2:
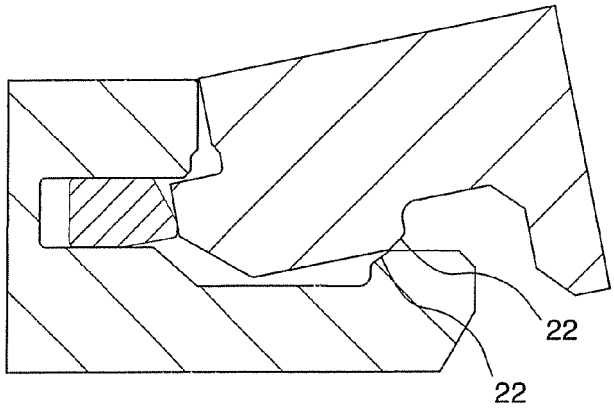
Figure 2:
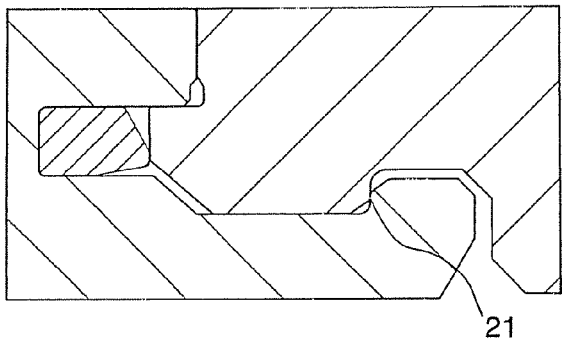

FIG. 2 shows in four steps a preferred connection method of the first panel with the combination lock C to the third panel with the T-lock. The panels are connected by angling and the flexible tongue is pushed into the displacement groove. The panels are preferable provided with guiding surfaces 22 which facilitate overcoming the displacement resistance of the flexible tongue. The width of the entrance E of the displacement groove is preferably at least equal to the thickness TT of the tongue. The entrance of the displacement groove is in this relationship defined to start at the joint plane.

Figure 3:
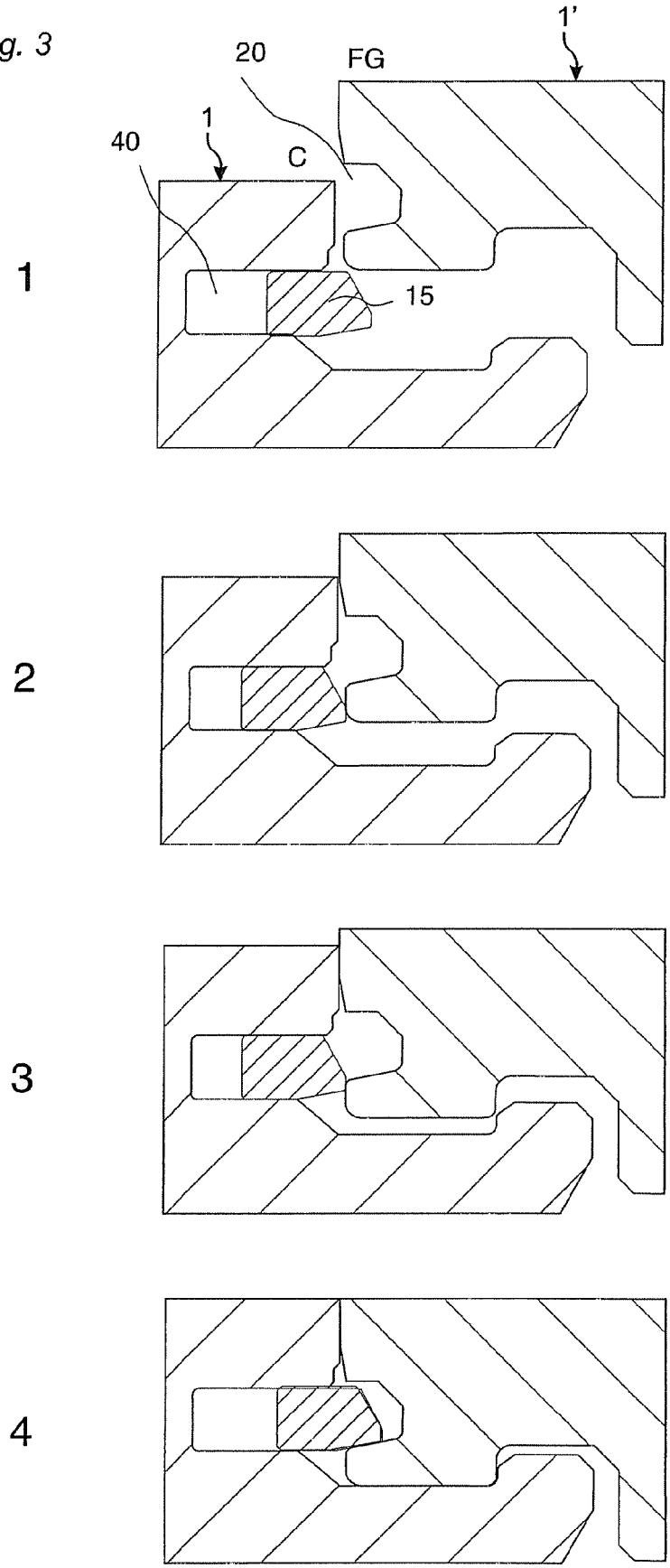
FIG. 3 shows an installation of two panels according to an embodiment of the invention, a tongue side of a panel is connecting a groove side of an adjacent panel.

FIG. 3 shows in four steps a preferred connection method of the first panel with the combination lock C to the second panel with the FG-lock. The panels are connected by folding or solely by vertical movement of the whole panel and the flexible tongue is during the connection pushed into the displacement groove and springs then back into the flexible tongue groove. The panels are preferable provided with guiding surfaces 22 which facilitate overcoming the displacement resistance of the flexible tongue.

A prior art floor panel 1, 1' provided with a mechanical locking system and a displaceable tongue is described with reference to FIGS. 4 and 5. The mechanical locking system provides locking of the panels relative to each other in the vertical direction D1 as well as the horizontal direction D2.

To provide joining of the two joint edges in the D1 and D2 directions, the edges of the floor panel have in a manner known per se a locking strip 6 with a locking element 8 in one joint edge, hereafter referred to as the "strip panel" which cooperates with a locking groove 14 in the other joint edge, hereafter referred to as the "fold panel", and provides the horizontal locking.

The prior art mechanical locking system comprises a separate flexible tongue 15 fixed into a displacement groove 40 formed in one of the joint edges. The flexible tongue 15 has a groove portion P1, which is located in the displacement groove 40 and a projecting portion P2 projecting outside the displacement groove 40. The projecting portion P2 of the flexible tongue 15 in one of the joint edges cooperates with a tongue groove formed in the other joint edge.

The flexible tongue 15 has a protruding part P2 with a rounded outer part 31 and a sliding surface 32, which in this embodiment if formed like a bevel. It has upper 33 and lower 35 tongue displacement surfaces and an inner part 34.

The displacement groove 40 has an upper 42 and a lower 46 opening, which in this embodiment are rounded, a bottom 44 and upper 43 and lower 45 groove displacement surfaces, which preferably are essentially parallel with the horizontal plane HP.

The tongue groove 20 has a tongue-locking surface 22, which cooperates with the flexible tongue 15 and locks the joint edges in a vertical direction D1. The fold panel 1' has a vertical locking surface 24, which is closer to the rear face 62 than the tongue groove 20. The vertical locking surface 24 cooperates with the strip 6 and locks the joint edges in another vertical direction. The fold panel has in this embodiment a sliding surface 23 which cooperated during locking with the sliding surface 32 of the tongue.

Figure 4A:
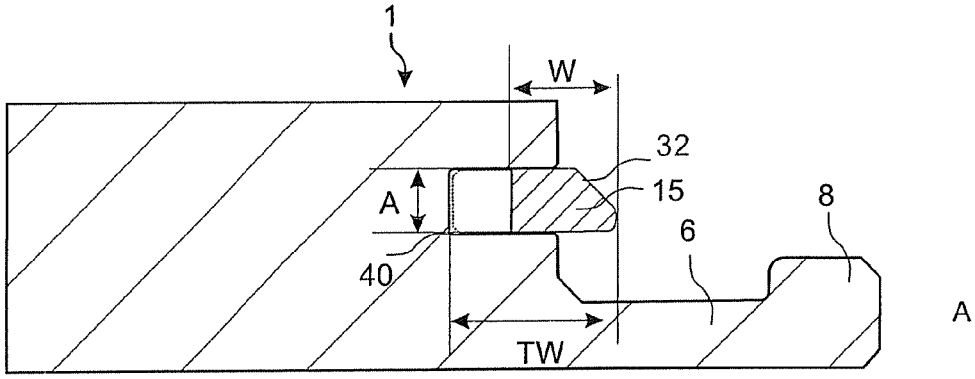
FIGS. 4*a-b* show short sides of two floor panels, according to prior art, with a locking system adapted for vertical folding.
Figure 4B:
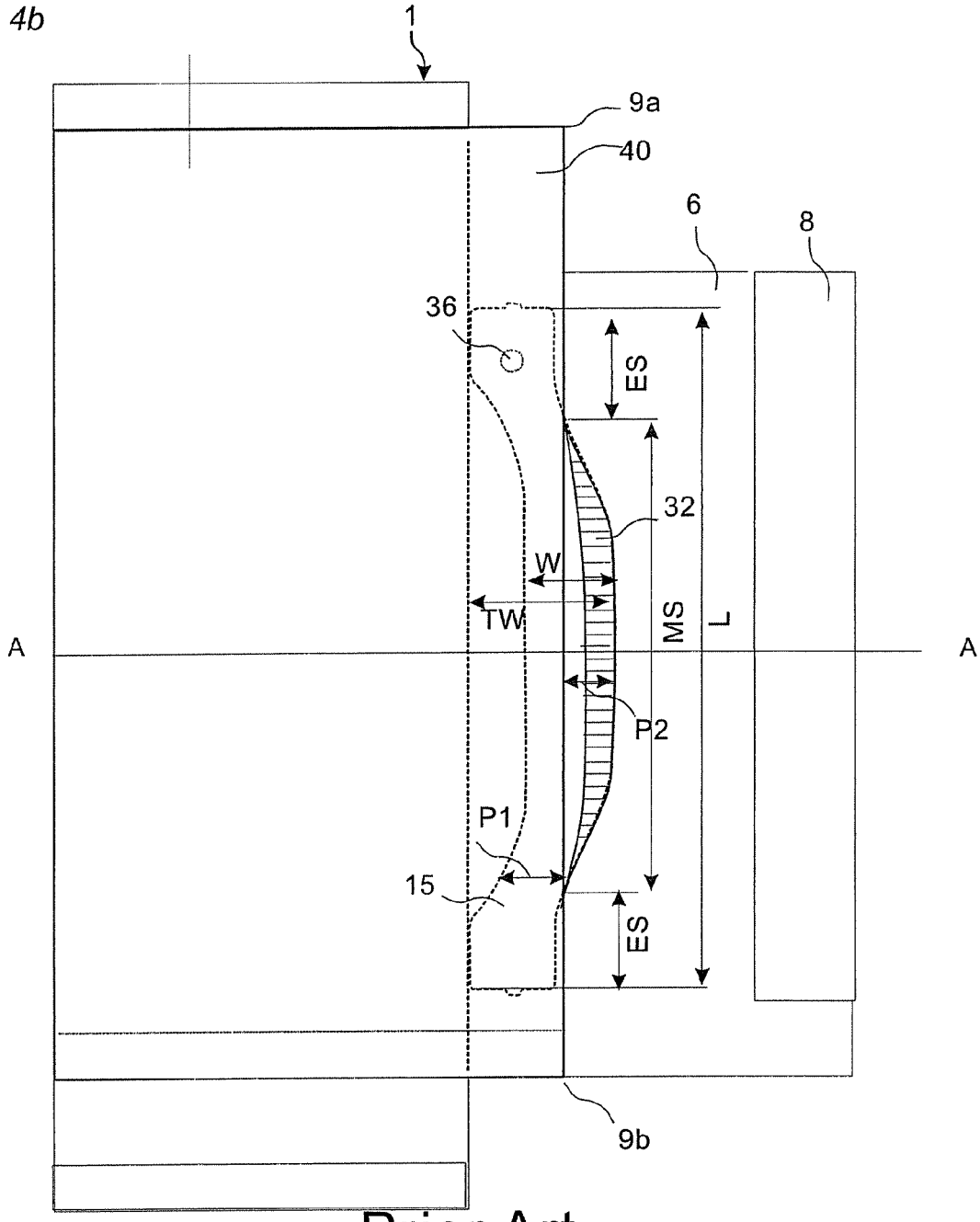

FIG. 4*a* shows a cross section A-A of a panel according to FIG. 4*b* seen from above. The flexible tongue 15 has a length L along the joint edge, a width W parallel to the horizontal plane and perpendicular to the length L and a thickness A in the vertical direction D1. The sum of the largest groove portion P1 and the largest protruding part P2 is the total width TW. The flexible tongue has also in this embodiment a middle section MS and two edge sections ES adjacent to the middle section. The size of the protruding part P2 and the groove portion P1 varies in this embodiment along the length L and the tongue is spaced from the two corner sections 9*a* and 9*b*. The flexible tongue 15 has on one of the edge sections a friction connection 36 which could be shaped for instance as a local small vertical protrusion. This friction connection keeps the flexible tongue in the displacement groove 40 during installation, or during production, packaging and transport, if the flexible tongue is integrated with the floor panel at the factory.

Figure 5A:
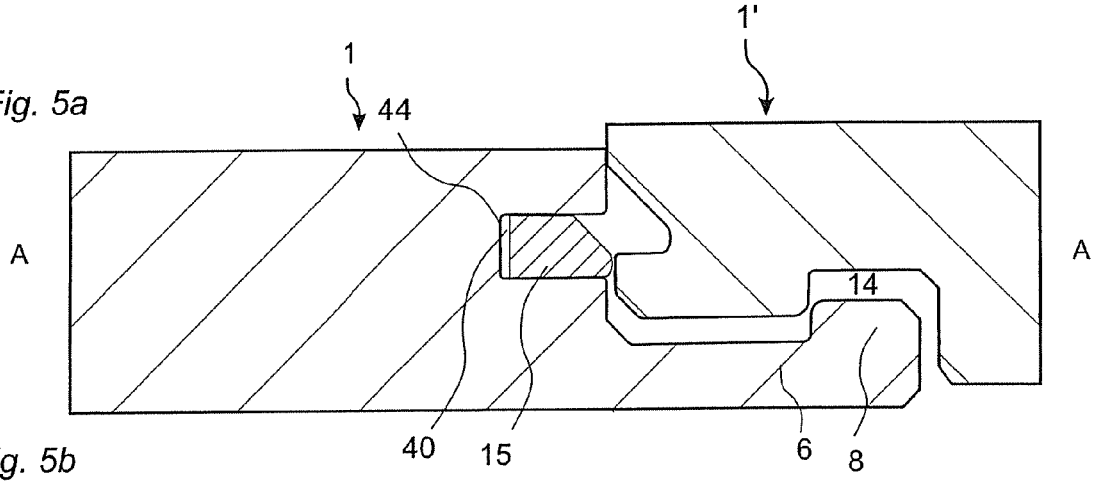
FIGS. 5*a-b* show locking of short sides of two floor panels, according to prior art, with a locking system adapted for vertical folding.
Figure 5B:
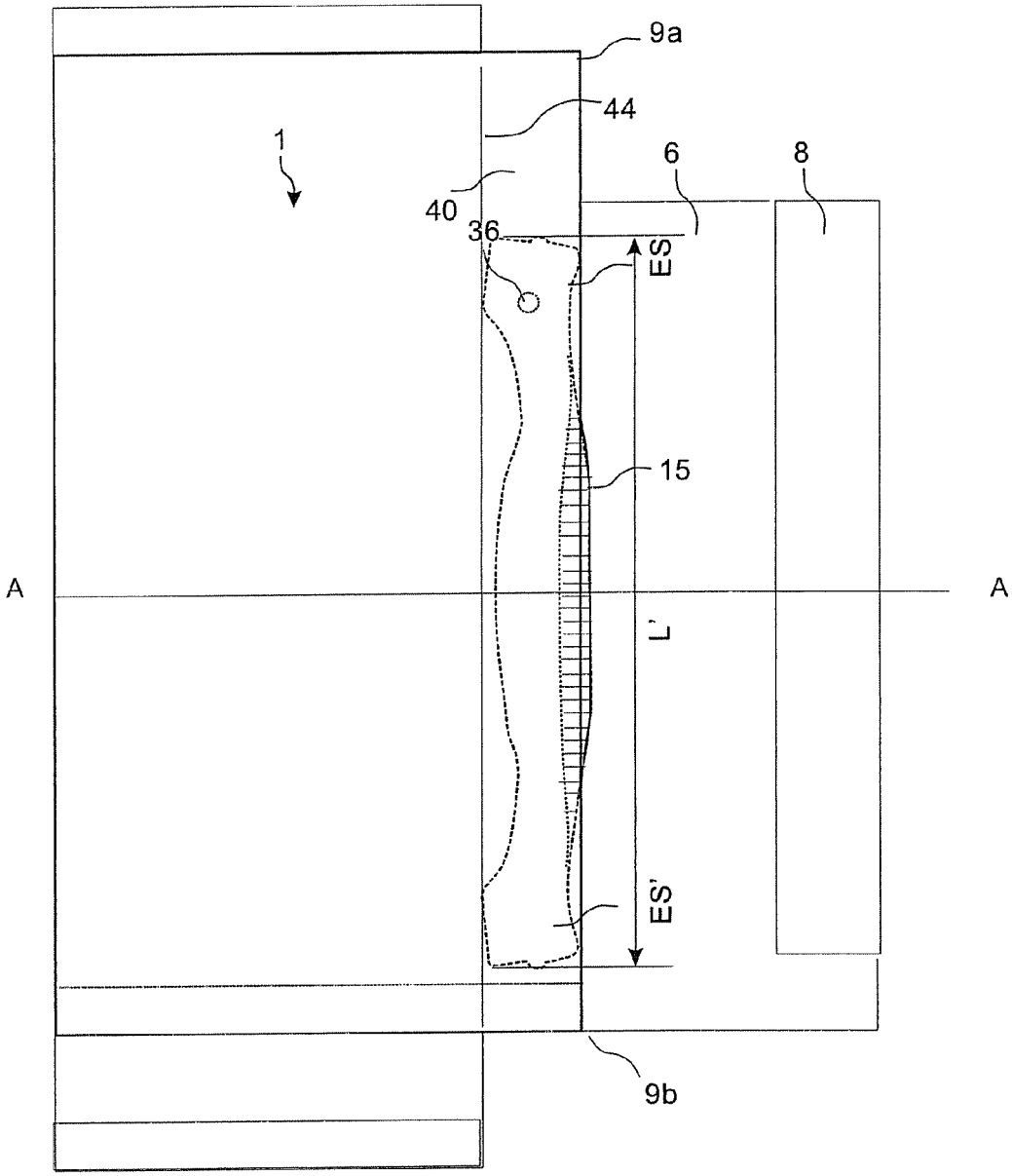

FIGS. 5*a* and 5*b* shows the position of the flexible tongue 15 after the first displacement, during the installation, towards the bottom 44 of the displacement groove 40. The displacement is caused essentially by bending of the flexible tongue 15 in its length direction L parallel to the width W. This feature is essential for this prior art.

Figure 6:
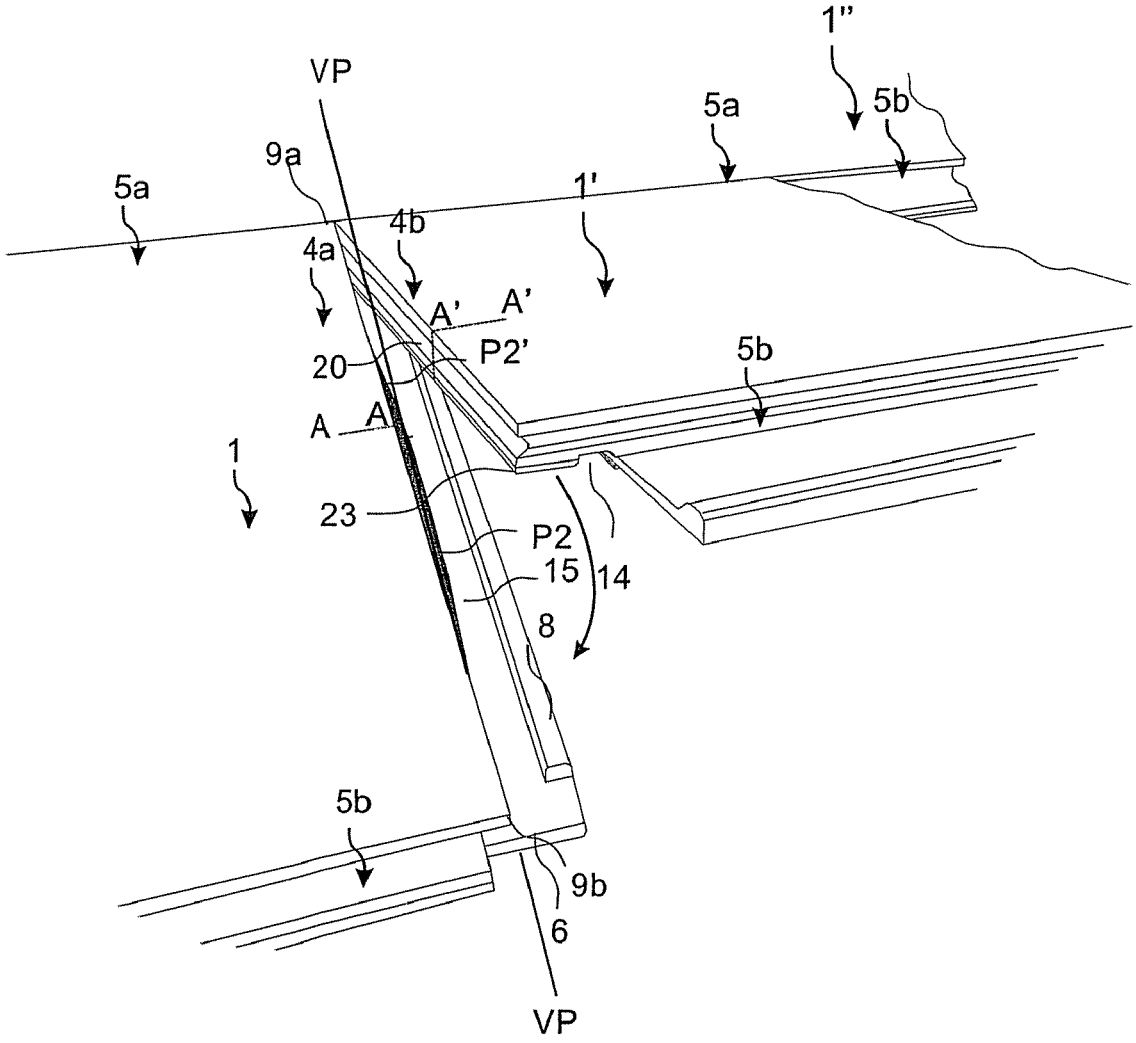
FIG. 6 shows locking with vertical folding in a 3D-view.

FIG. 6 shows one embodiment of a vertical folding. A first panel 1" in a first row is connected to a second 1 panel in a second row. The new panel 1' is connected with its long side 5*a* to the long side 5*b* of the first panel with angling. This angling action also connects the short side 4*b* of the new pane with the short side 4*a* of the second panel. The fold panel 1' is locked to the strip panel 1 with a combined vertical and turning motion along the vertical plane VP. The protruding part P2 has a rounded and or angled folding part P2' which during folding cooperates with the sliding surface 23 of the folding panel 1'. The combined effect of a folding part P2', and a sliding surface 32 of the tongue which during the folding cooperates with the sliding surface 23 of the fold panel 1' facilitates the first displacement of the flexible tongue 15. An essential feature of this embodiment is the position of the projecting portion P2, which is spaced from the corner section 9*a* and 9*b*. The spacing is at least 10% of the length of the joint edge, in this case the visible short side 4*a*.

FIGS. 7*a-e* shows embodiments of the displaceable tongue 15, which are applicable according to the invention, besides the bow shaped tongue shown in FIG. 4 and 5. Tongues are preferably made of moulded plastic. Any type of polymer materials could be used such as PA (nylon), POM, PC, PP, PET or PE or similar having the properties described above in the different embodiments. These plastic materials could be when injection moulding is used be reinforced with for instance glass fiber, Kevlar fiber, carbon fiber or talk or chalk. A preferred material is glass fiber, preferably extra long, reinforced PP or POM.

Figure 7A:
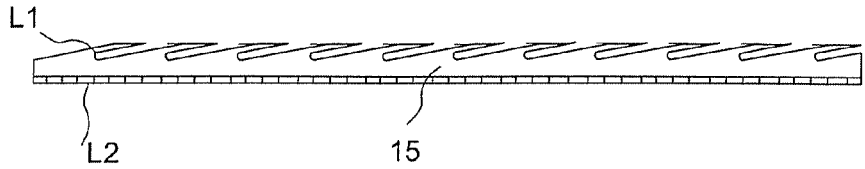
FIGS. 7*a-e* show displaceable tongues in embodiments according to the invention.

FIG. 7*a* shows an embodiment with a first long edge L1 and a second long edge L2. The first long edge has protrusions extending in a plane parallel to the topside 64 of the tongue 15 and with an angle relative the longitudinal direction of the tongue.

Figure 7B:
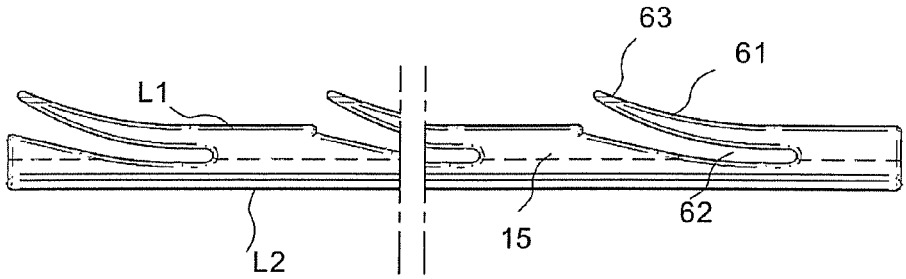

FIGS. 7*a-b* show the embodiment, in top and in a side view, with a first long edge L1 and a second long edge L2. The first long edge has protrusions 61 extending in a plane parallel to the topside, an upper displacement surface 61, and rear side, a lower displacement surface, of the tongue and with an angle relative the longitudinal direction of the tongue. The protrusions are preferably bow shaped and, in a particular preferred embodiment, the tongue is provided with a recess 62 at each protrusion 61. The recess is preferably adapted to the size and shape of the protrusion.

The protrusions are preferably provided with a friction connection 63, most preferably close to or at the tip of the protrusion, which could be shaped for instance as a local small vertical protrusion. This friction connection keeps the flexible tongue in the displacement groove 40 during installation, or during production, packaging and transport, if the displaceable tongue is integrated with the floor panel at the factory.

Figure 7C:
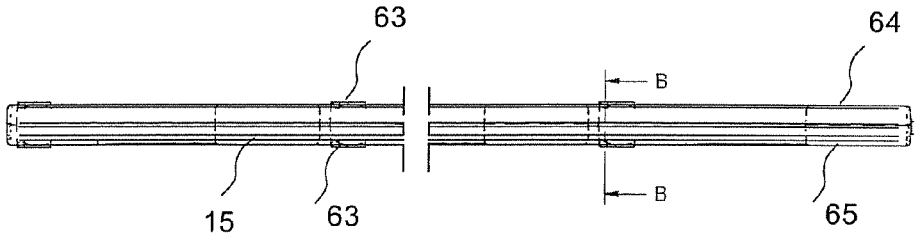
Figure 7D:
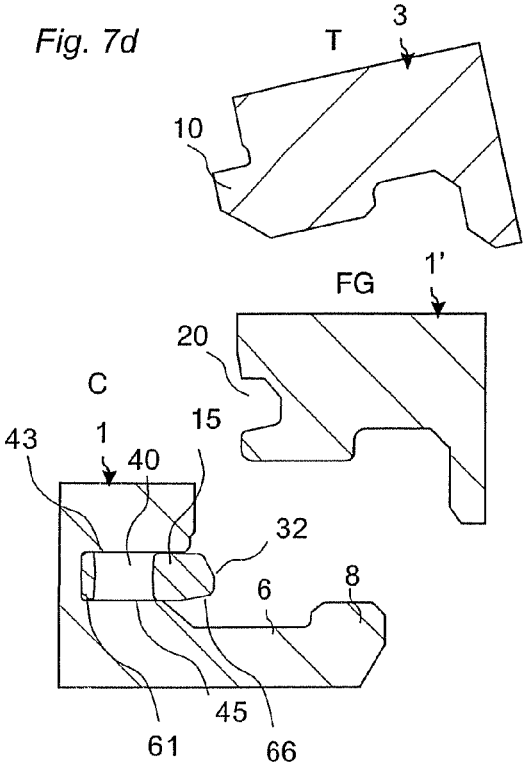

FIG. 7*d* shows one embodiment of the locking system according to the invention illustrating the tongue 15 in the cross section B-B in FIG. 7*c* and positioned in the displacement groove 40 of a first panel 1 with a combination lock C. The upper and lower displacement surface of the tongue is configured to cooperate with an upper 43 and a lower 45 groove displacement surfaces. The panel comprising a locking strip 6 and a locking element 8 for horizontal locking. The panel 1 is configured to be connected to a second panel 1' in a similar way as the shown in FIG. 2 or 3. The upper displacement surface (64) and/or the lower displacement surface (65) of the tongue is in one preferred embodiment provided with a bevelled edge, presenting a sliding surface (32, 31) and an inclined locking surface (66), respectively. The inclined locking surface cooperates preferably with an inclined tongue-locking surface 22 in the tongue groove 20. The combination lock C, may be connected to a second panel 1' provided with the FG-lock or to a third panel provided with the T-Lock.

In the embodiments according to FIG. 7*d*, the displacement groove (40) is formed in one piece with the core of the panel, but other alternatives are possible. The Displacement groove may be formed in a separate material, for example HDF, which is connected to a wood core in a parquet floor. The displacement groove may be formed of U-shaped plastic or metal sections, which are connected to the panel with for example a snap connection, glue or friction. These alternatives could be used to reduce friction and to facilitate horizontal displacement of the tongue in the displacement grove. The displacement groove may also be treated with a friction reducing agent. These principles may also be applied to the tongue groove.

Figure 7E:
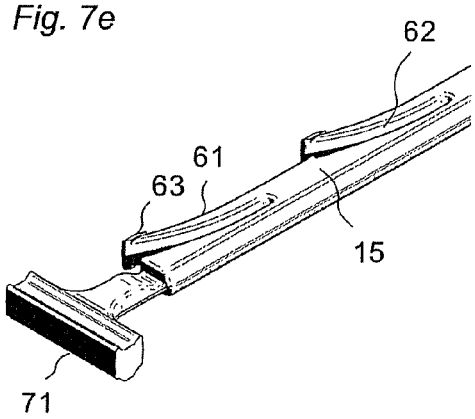

The FIG. 7*e* shows a casting gate 71 which is cut of before insertion into the displacement groove.

Figure 8A:
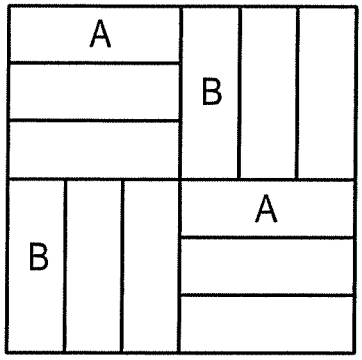
FIGS. 8*a-e* show embodiments of applicable installation patterns.
Figure 8B:
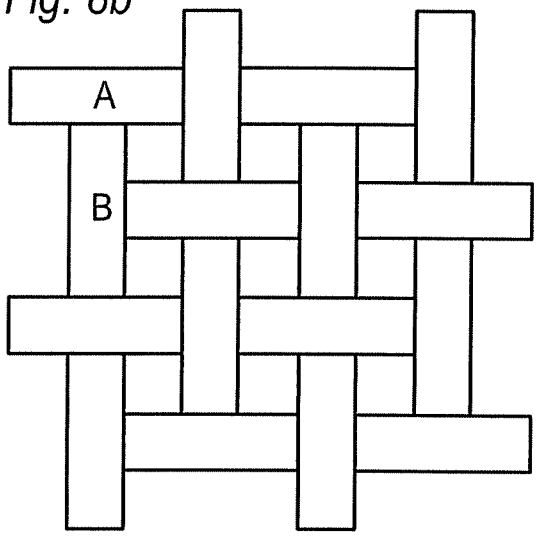
Figure 8C:
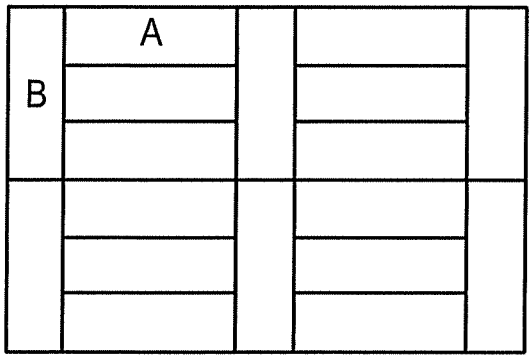
Figure 8D:
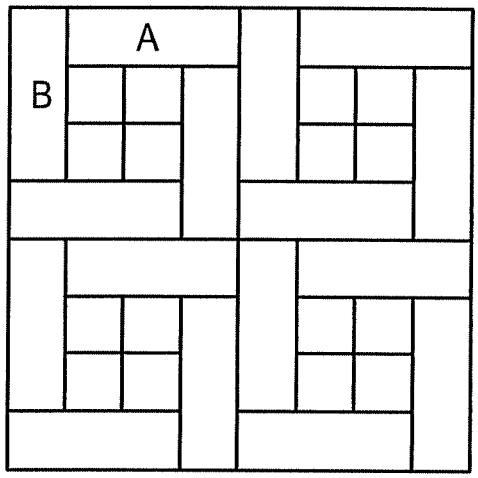
Figure 8E:
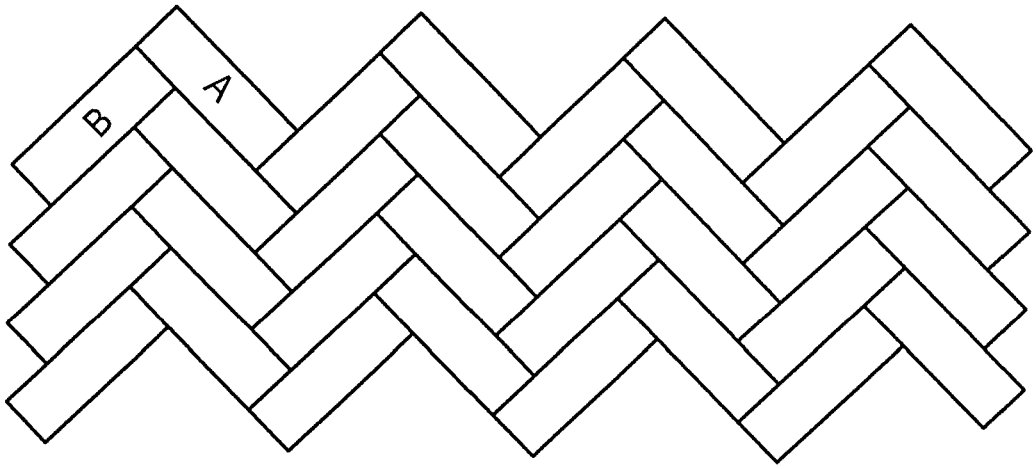

FIGS. 8*a-e* show different installation pattern, which are possible to install with the locking system and set of floor panels according to the invention. FIG. 8*a* shows a pattern with three floor panels connected at the short edges to a long edge of a panel with mirror inverted connecting devices, A and B-panels, which is explained below and in FIGS. 9*a-e*. The pattern consists of a group of three panels in first direction, surrounded by groups of three panels in a perpendicular direction. FIG. 8*b* show a quadratic panel connected at all edges to a long edge of a rectangular. FIG. 8*c* shows a pattern in which a panel in a first direction is connected at an edge to three panels in a second perpendicular direction, which is connected to a first long edge of a fourth panel in the first direction, whose opposite edge is connected to three panels in the second direction, continued in a repeating manner. FIG. 8*d* shows a pattern comprising a group of four connected quadratic panels surrounded and connected to the long edges of rectangular panels. FIG. 8*e* shows a traditional herringbone pattern. All these installation patterns involve connecting of a short side to a long side. The invention provides a solution, which make it possible to install the patterns with a vertical folding method, connecting the panels with a strong joint in the vertical and the horizontal direction. The pattern involves joining of, e.g., (cf. FIGS. 9, 12):

- a short edge provided with a combination lock C to a long edge provided with the T-lock
- a short edge provided with the FG-lock to a long edge provided with the combination lock C
- a long edge provided with the combination lock C to a long edge with the T-lock
- a short edge provided with the FG-lock to a short edge provided with the combination lock C
- an edge of a quadratic panel provided with a combination lock C to another edge of a quadratic panel provided with the T-lock
- an edge of a quadratic panel provided with a combination lock C to another edge of a quadratic panel provided with the FG-lock
- an edge of a quadratic panel provided with a combination lock C to a long edge provided with the FG-lock
- an edge of a quadratic panel provided with a combination lock C to a long edge provided with the T-lock
- an edge of a quadratic panel provided with a FG-lock to a long edge provided with the combination lock C
- an edge of a quadratic panel provided with a T-lock to a long edge provided with the combination lock C The short edge of an A-panel are preferably joined to the long edge of a B-panel, as is common for installation with A and B-panels.

Figure 9A:
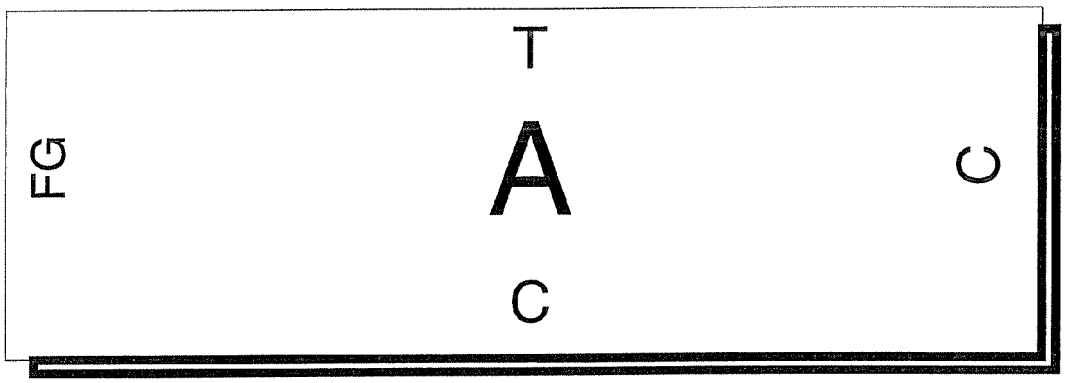
FIGS. 9*a-d* show embodiments of the locking system of the invention applied to rectangular and square A and B panels.
Figure 9B:
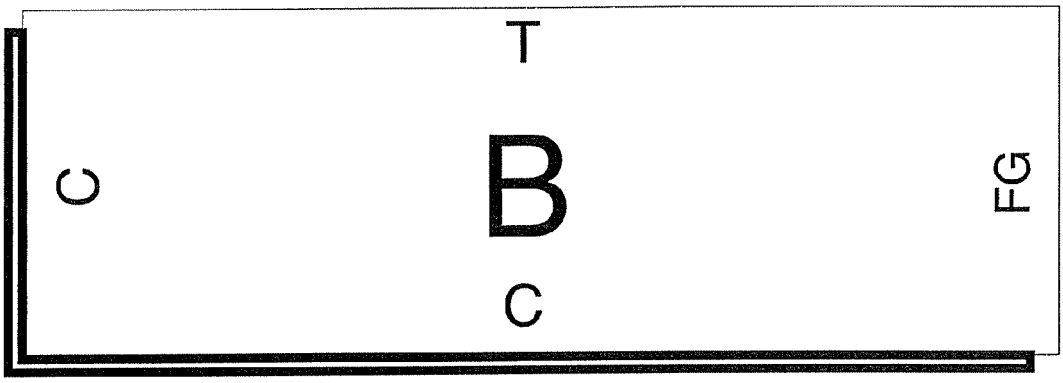
Figure 9C:
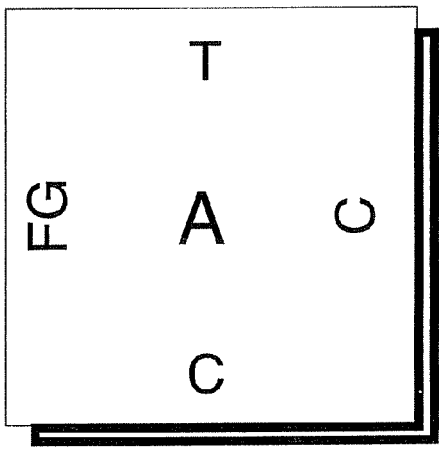
Figure 9D:
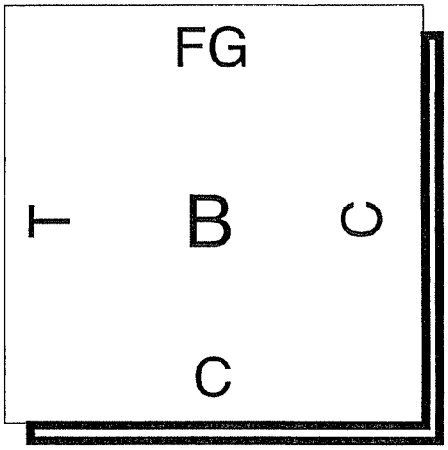

One way to enable connecting of a short side to a long side is to provide A-panels and B-panels with mirror inverted connecting devices, as is shown in FIG. 9*a-d*. Two adjacent edges of the panels are provided with the combination lock C, one edge with the FG-Lock and one edge provided with the T-lock. The three types of connecting devices C, FG, T are distributed mirror inverted on the A and on the B panel. FIG. 9*a* shows a rectangular A-panel with long and short edges. FIG. 9*b* shows a rectangular B-panel with long and short edges. FIG. 9*a* shows a quadratic A-panel and 9*b* shows a quadratic B-panel.

Figure 10A:
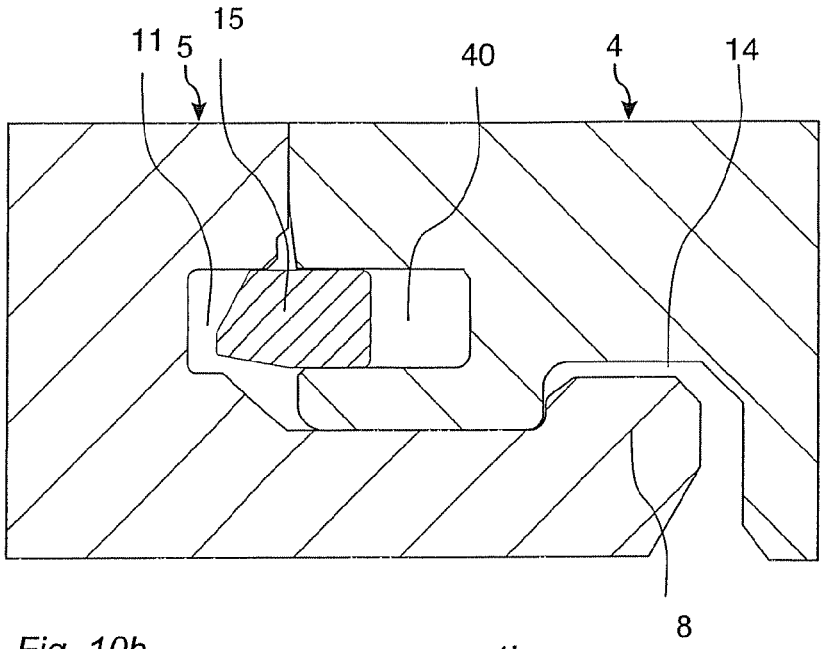
FIG. 10*a* shows a prior art locking system.

FIG. 10*a* shows an embodiment wherein a displaceable flexible tongue 15 and a displacement groove 40 is provided on fourth connecting device on a fourth panel 4 comprising a locking groove 14. This makes it possible to connect a short side, with the fourth connecting device, of a floor panel 4 to a long side of fifth panel 5 comprising a standard connecting device, comprising locking element 8 and tongue groove 11 for connection by angling, with vertical folding. The problem is that this solution creates a thin section between the bottom of the displacement groove 40 and the locking groove 14, resulting in a weak joint.

Figure 10B:
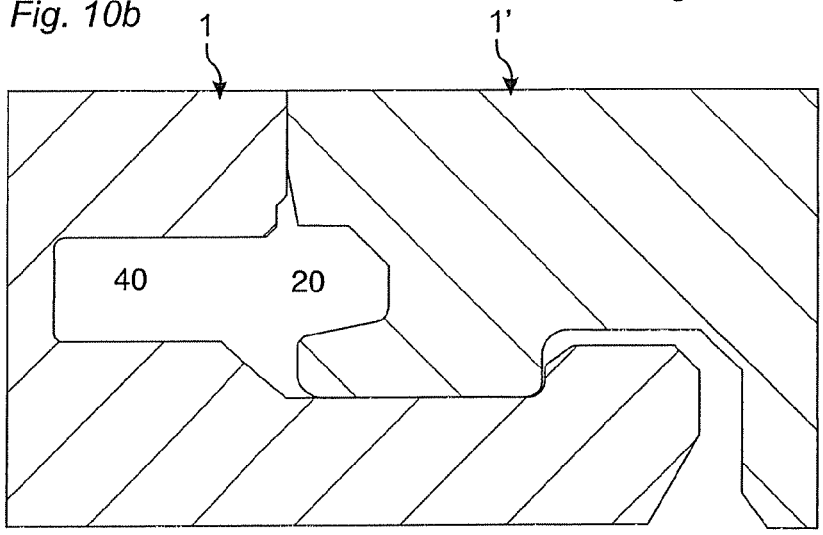
FIGS. 10*b-d* show embodiments of the locking system according to the invention.

FIG. 10*b* shows an embodiment wherein the flexible tongue is removed and the joint is only locking in the horizontal direction.

Figure 10C:
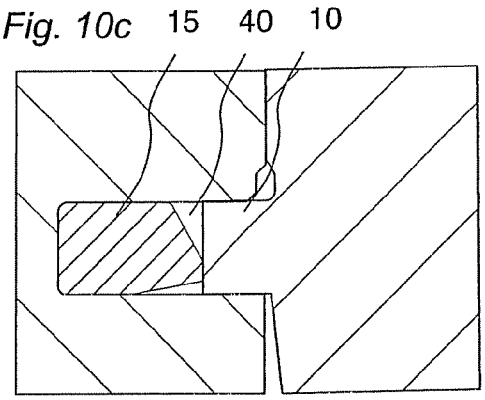
Figure 10D:
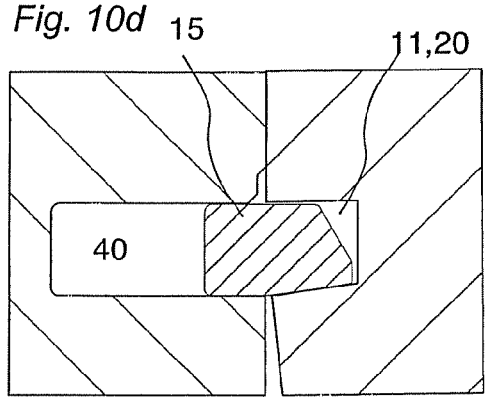

FIG. 10*c-d* show how the principles of the invention may be applied to tongue-groove joint, without any horizontally locking. FIG. 10*c* illustrates a panel with a flexible tongue 15 and a displacement groove 40 cooperating with a tongue 10 of a tongue panel. FIG. 10*d* illustrates a groove panel with a flexible tongue groove 20 cooperating with the flexible tongue 15. The groove panel may be connected also to a tongue panel with a tongue cooperating with the groove 11.

Figure 11:
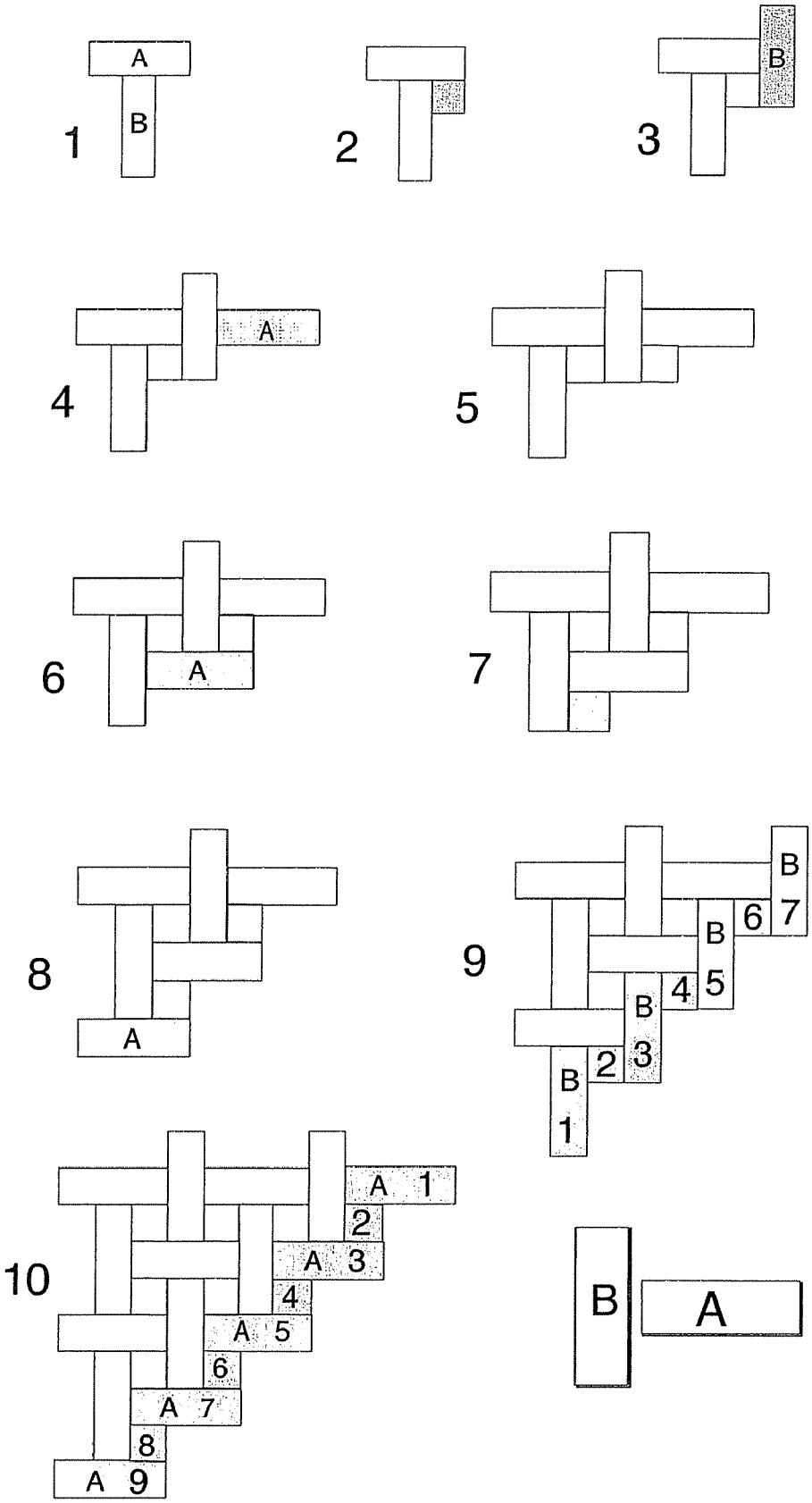
FIG. 11 shows an installation of panels in a pattern, comprising A, B and square panels for which the locking system of the invention is applicable.

FIG. 11 shows in 10 steps a preferred connection method of A and B-panels, quadratic and with long and short edges in an advanced pattern. Short edges are joined to long edges and the quadratic panels are at all edges joined with long edges.

Figure 12A:
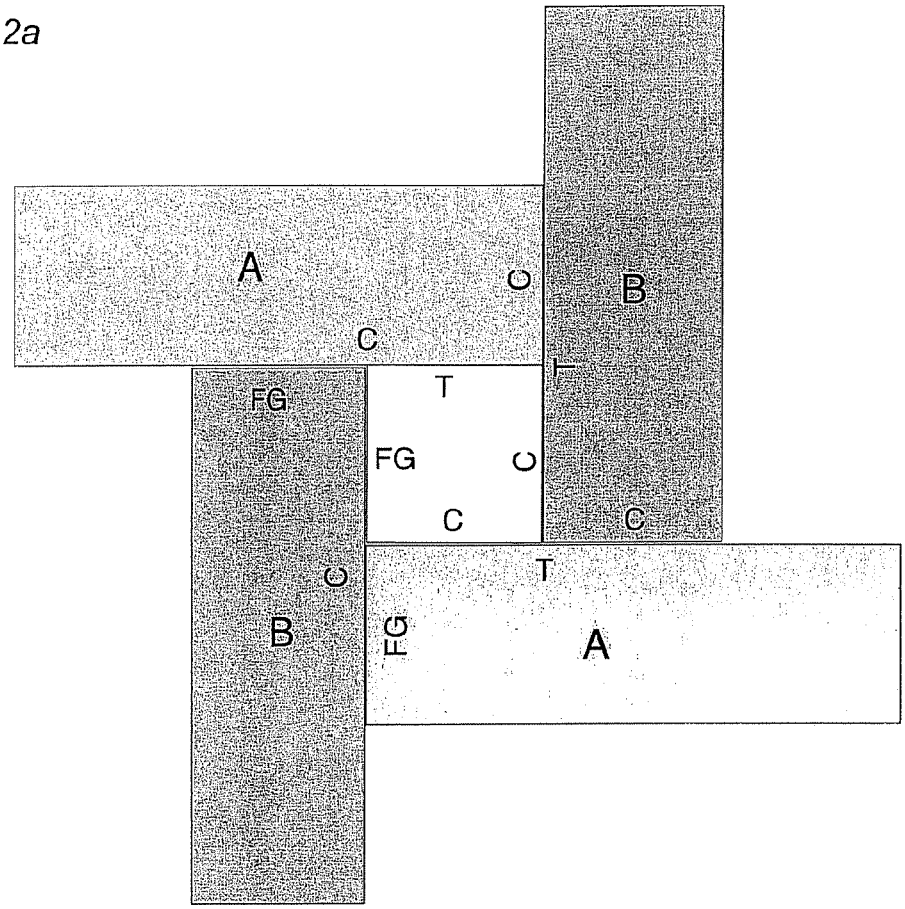
FIGS. 12*a-b* shows an embodiment of a combination of locking system, comprising rectangular and quadratic A and B panels for which the locking system of the invention is applicable.

FIG. 12*a* shows an enlarged part of the pattern in FIG. 11 and how the combination loc is distributed to generate the A and B-panels and to enable the pattern.

Figure 12B:
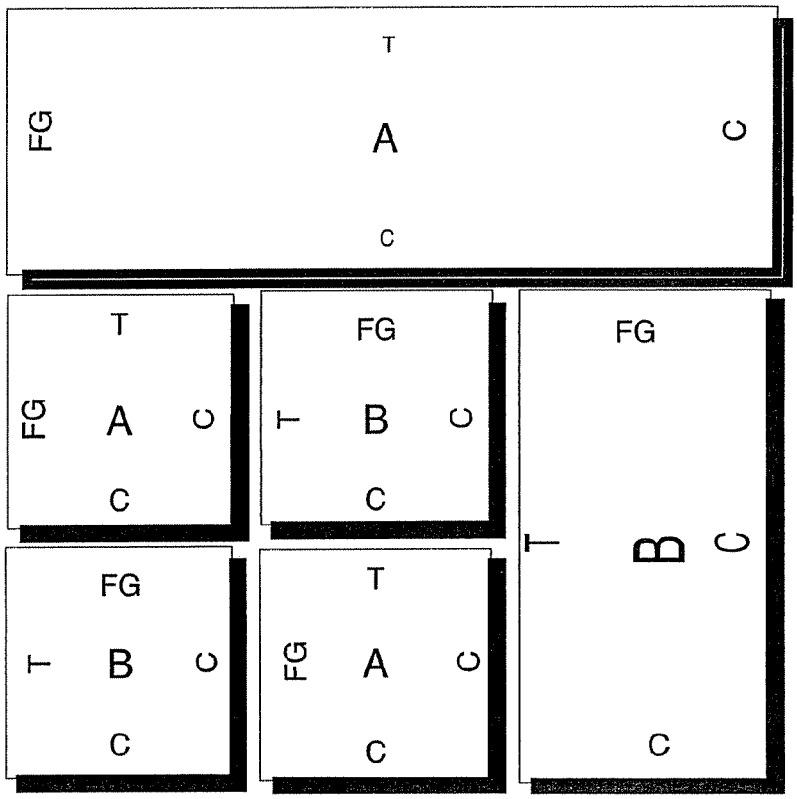

FIG. 12*b* shows how the combination loc is distributed to generate the quadratic A and B-panels. The panels are connected in manner avoiding a row with several CFG-joints, which is a joint between a combination lock against to a FG-lock, in a line. This is an advantage, since a CT-joint, which is a joint between the combination loc C to a T-lock, offers a stronger connection in the vertical direction. Consequently it is preferred that every second joint in a line is a CFG-joint and provided there between is a CT-joint. The figure also shows an embodiment of the distribution of the connecting devices to provide, which make it possible to connect several quadratic panels to a long edges of a rectangular panel. Several edges of the quadratic panels with the combination lock may be connected to a long edge with the T-lock. Quadratic panels, with edges in a line having the FG-lock and the T-lock, may be connected to a long edge with the combination lock C.

A disadvantage with the CT-joint is that the flexible tongue pushes the panels apart and possible causing a gap between the panels. One solution to avoid this is to adapt the stiffness of the flexible tongue, so that the force pushing the panels apart is reduced, but this also influence the final position in a CFG-joint. A second solution is that the flexible tongue is configured to be cracked or destroyed when the tongue pushes it into the displacement groove. A third solution is a strong locking element with guiding surfaces, facilitating the installation. A fourth solution is to dissolve or remove the tongue. It is also possible to provide the joint edges with bevels or decorative grooves, which hidden the gap.

The invention is not restricted to the above-mentioned illustrative embodiments, but is naturally applicable to other embodiments within the scope of the following patent claims, and equivalents thereof.

The invention claimed is:

1. A locking system for a floor panel comprising:

a first connecting device comprising an integrated combination lock at a first edge of a first floor panel, the combination lock configured to connect the first floor panel to another floor panel, so that upper joint edges of the floor panels in a connected state define a vertical plane, the integrated combination lock comprising an upwardly directed locking element configured to cooperate with a locking groove of a second connecting device at the edge of a second floor panel for connecting the first floor panel with said second floor panel in a horizontal direction perpendicular to said vertical plane, the combination lock further comprising a flexible tongue in a displacement groove, the flexible tongue configured to cooperate with a tongue groove of the second connecting device for connecting the first and the second floor panel together in a vertical direction parallel to the vertical plane, and the displacement groove and the flexible tongue of the combination lock are configured to cooperate with a tongue of a third connecting device at the edge of a third panel, for connecting the first panel and the third panels in the vertical direction parallel to the vertical plane.

2. The locking system as claimed in claim 1, wherein the flexible tongue is displaceable by the tongue of the third panel.

3. The locking system as claimed in claim 1, wherein a depth of the displacement groove is at least equal to a sum of the width of the flexible tongue and the width of the tongue of the third panel.

4. The locking system as claimed in claim 1, wherein a width of an entrance of the displacement groove is at least equal to a thickness of the tongue.

5. The locking system as claimed in claim 1, wherein the first panel is a rectangular A-panel and the third panel is a rectangular B-panel, the A and B-panels are provided with the first, second and third connecting devices, which are positioned mirror inverted on the A and B-panels.

6. The locking system as claimed in claim 5, wherein the second panel is a B-panel.

7. The locking system as claimed in claim 1, wherein each panel is provided with the combination lock at two of its edges.

8. The locking system as claimed in claim 1, wherein the combination lock is positioned at a long edge of the first panel and is configured to cooperate with the tongue at a short edge of the third panel.

9. The locking system as claimed in claim 1, wherein the third panel is square, and the combination lock is positioned at a long edge of the first panel and is configured to cooperate with the tongue at the edge of third panel.

10. The locking system as claimed in claim 1, wherein the floor panels are square.

11. The locking system as claimed in claim 1, wherein the flexible tongue is displaceable in the horizontal direction in the displacement groove and the flexible tongue comprises at least two protrusions at a first long edge of the tongue, bendable in the horizontal plane, and extending essentially in the horizontal direction, and the flexible tongue has a second long edge which when connected to the second panel, extends outside the displacement groove and the outer edge of the second long edge is essentially straight over substantially the whole length of the flexible tongue.

12. The locking system as claimed in claim 11, wherein there is an angle between the protrusions and the longitudinal direction of the flexible tongue.

13. The locking system as claimed in claim 11, wherein the protrusions are bow shaped.

14. The locking system as claimed in claim 11, wherein the protrusions extend into the displacement groove.

15. The locking system as claimed in claim 1, wherein the flexible tongue is displaceable in the horizontal direction in the displacement groove and is bow shaped.

16. The locking system as claimed in claim 1, wherein the locking element is configured to cooperate with a locking grove of the third locking device.

17. The locking system as claimed in claim 1, wherein the first floor panel is configured to be locked to the second or third floor panel with vertical folding or solely vertical movement.

18. A set of floor panels, comprising:

a first floor panel, a second floor panel, and a third floor panel, the first floor panel comprising a first connecting device comprising an integrated combination lock at a first adjacent edge and a second adjacent edge of the first floor panel, the combination lock is configured to connect the first floor panel to the second and the third floor panels so that upper joint edges of the floor panels in a connected state define a vertical plane, the combination lock comprises an upwardly directed locking element configured to cooperate with a locking groove of an adjacent second connecting device at a first edge of the second floor panel and of an adjacent third connecting device at a first edge of the third floor panel for connecting the first and second edge of the first floor panel with said second and third floor panels in a horizontal direction perpendicular to said vertical plane, and the combination lock further comprises a flexible tongue in a displacement groove, the flexible tongue configured to cooperate with a tongue groove of the second connecting device for connecting the first edge of the first panel and the first edge of the second floor panel together in a vertical direction parallel to the vertical plane, the displacement groove and the flexible tongue of the combination lock at the second edge of the first panel are configured to cooperate with a tongue of the third connecting device at the first edge of the third panel for connecting the second edge of the first panel and the first edge of the third panel in the vertical direction parallel to the vertical plane.

19. The set of floor panels as claimed in claim 18, wherein the floor panels are rectangular and the first edge of the first floor panel is a long edge and the second edge of first floor panel is a short edge.

20. The set of floor panels as claimed in claim 19, wherein the first edge of the third floor panel is a long edge.

21. The set of floor panels as claimed in claim 19, wherein the first edge of the second floor panel is a short edge.

22. The set of floor panels as claimed in claim 18, wherein the panels are square.

23. The set of floor panels as claimed in claim 18, wherein the first panel is a rectangular A-panel and the third panel is a rectangular B-panel, the A and B-panels are provided with the first, second and third connecting devices, which are positioned mirror inverted on the A and B-panels.

24. The set of floor panels as claimed in claim 18, wherein the second panel is a B-panel.

25. The set of floor panels as claimed in claim 18, wherein each panel is provided with the combination lock at two of its edges.

26. The set of floor panels as claimed in claim 18, wherein the first floor panel is configured to be locked to the second or third floor panel with vertical folding or solely vertical movement.

* * * * *